US009777967B2

(12) United States Patent
Rice

(10) Patent No.: US 9,777,967 B2
(45) Date of Patent: Oct. 3, 2017

(54) TEMPERATURE GLIDE THERMOSYPHON AND HEAT PIPE

(71) Applicant: J R Thermal LLC, Austin, TX (US)

(72) Inventor: Jeremy Rice, Austin, TX (US)

(73) Assignee: J R Thermal LLC, Austin, TX (US)

( * ) Notice: Subject to any disclaimer, the term of this patent is extended or adjusted under 35 U.S.C. 154(b) by 181 days.

(21) Appl. No.: 14/825,320

(22) Filed: Aug. 13, 2015

(65) Prior Publication Data

US 2016/0054073 A1 Feb. 25, 2016

Related U.S. Application Data

(60) Provisional application No. 62/041,418, filed on Aug. 25, 2014.

(51) Int. Cl.

| | |
|---|---|
| ***F28D 15/00*** | (2006.01) |
| ***F28D 15/04*** | (2006.01) |
| ***F28D 15/02*** | (2006.01) |

(52) U.S. Cl.

CPC ..... *F28D 15/043* (2013.01); *F28D 15/0266* (2013.01); *F28D 15/046* (2013.01)

(58) Field of Classification Search

CPC .. F28D 15/043; F28D 15/0266; F28D 15/046; H05K 7/20881

USPC ..... 165/104.21

See application file for complete search history.

(56) References Cited

U.S. PATENT DOCUMENTS

| | | | | |
|---|---|---|---|---|
| 4,771,824 | A | 9/1988 | Rojey et al. | |
| 5,062,985 | A * | 11/1991 | Takemasa | C09K 5/044 252/67 |
| 2007/0193723 | A1 | 8/2007 | Hou et al. | |
| 2009/0199585 | A1* | 8/2009 | Ogawa | F28D 1/0477 62/324.2 |
| 2011/0048676 | A1 | 3/2011 | Toyoda et al. | |
| 2014/0007613 | A1* | 1/2014 | Uchida | B60H 1/004 62/509 |

FOREIGN PATENT DOCUMENTS

| | | |
|---|---|---|
| EP | 2042825 A1 | 4/2009 |
| KR | 10-0671041 B1 | 1/2007 |

OTHER PUBLICATIONS

International Search Report and Written Opinion dated Oct. 27, 2015 in corresponding International Application No. PCT/US2015/044986.

* cited by examiner

*Primary Examiner* — Davis Hwu

(74) *Attorney, Agent, or Firm* — DuBois, Bryant & Cambell, LLP; William D. Wiese

(57) ABSTRACT

Fluid to fluid heat exchange processes involve the hot fluid reducing in temperature and the cold fluid increasing in temperature. To transfer heat between the two fluids, a third, separated heat transfer fluid is often used. The present invention allows for passive heat transfer between the two fluids, using a separate heat transfer fluid, while enabling heat absorption and rejection through a continuously variable temperature.

8 Claims, 12 Drawing Sheets

TEMPERATURE GLIDE THERMOSYPHON AND HEAT PIPE

PRIORITY STATEMENT UNDER 35 U.S.C. §119

This application claims priority under 35 U.S.C. §119 based upon prior U.S. Provisional Patent Application Ser. No. 62/041,418, filed Aug. 25, 2014, in the name of Jeremy Rice, entitled "TEMPERATURE GLIDE THERMOSYPHON AND HEAT PIPE," the disclosure of which is incorporated herein in its entirety by this reference.

BACKGROUND OF THE INVENTION

Passive, two-phase (liquid/vapor) heat transfer devices, including several types of heat pipes and thermosyphons, are generally constant temperature heat transfer devices. A schematic of these devices in accordance with prior art is presented in FIG. 1. Heat released from a hot air stream 105 is transferred to the cool airstream 107 by the heat pipe or thermosyphon. Vapor 110 flows in the center of the heat pipe, and liquid 111 flows on the inside perimeter, and is driven by gravity (for thermosyphons) or capillary action (for heat pipes). Heat pipes and thermosyphons, in accordance with prior art, are designed to operate as constant temperature devices. This can introduce design problems, as coolants, like air, which remove heat from heat pipes and thermosyphons, use sensible energy, thus requiring a change of temperature to absorb and release heat.

In order to get a counter-flow heat exchanger effect between hot 105 and cold 107 fluids, several heat pipes are necessary within the same heat exchanger. The need for several individual heat pipes can have the effect of increasing costs and the complexity of the system integration. The complexity can increase significantly, as the distance between the hot 105 and cold 107 fluids streams increases. Additionally, if there is a desire to control the heat flow rate by valves, the number of valves necessary, scales with the number of heat pipes. These attributes can severely limit conventional heat pipes and thermosyphons from many practical applications.

SUMMARY OF THE INVENTION

The present invention enables thermosyphons and heat pipes, both of which are passive, phase change devices, to mimic the sensible heating characteristics of air and water, by charging them with component mixtures exhibiting a temperature glide effect. This attribute enables the invention to act as an intermediate heat transfer loop between fluids and still achieve a counter-flow heat transfer effect with a single loop. Several attributes are introduced which ensure a unidirectional internal flow, so that the temperature glide effect can be utilized in a manner that is beneficial to the application.

The invention can be used for air to air heat transfer applications, such as heat recovery over the evaporator coil of a vapor compression cycle to reduce the sensible heat ratio. Since the invention mimics the sensible characteristics of air, a single loop heat recovery loop may be utilized, allowing for easy control through a single flow control valve.

The present invention can also be utilized for cooling of electronics devices. It can be used in situations where the most sensitive electronics components are downstream, with respect to system airflow, of less sensitive components. The invention can enable flexible cooling, by delivering cool refrigerant to the most sensitive components, irrespective of their placement within a system.

DETAILED DESCRIPTION

Figure 1:
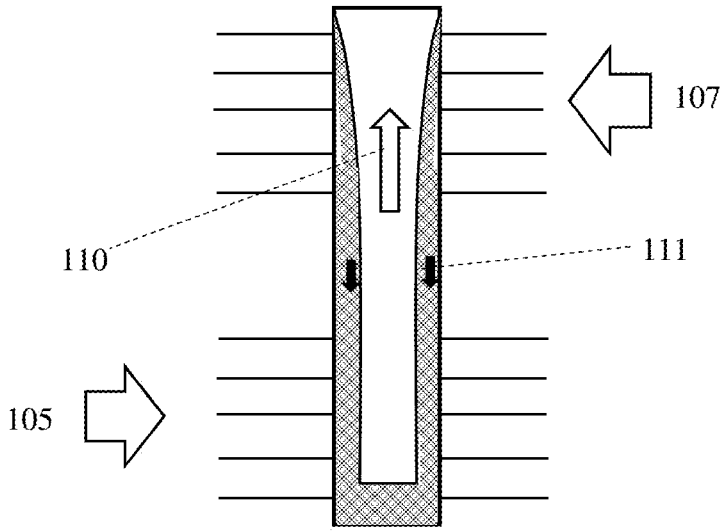
FIG. 1 is a schematic of a thermosyphon or heat pipe transferring heat between two fluids in accordance with prior art.
Figure 2:
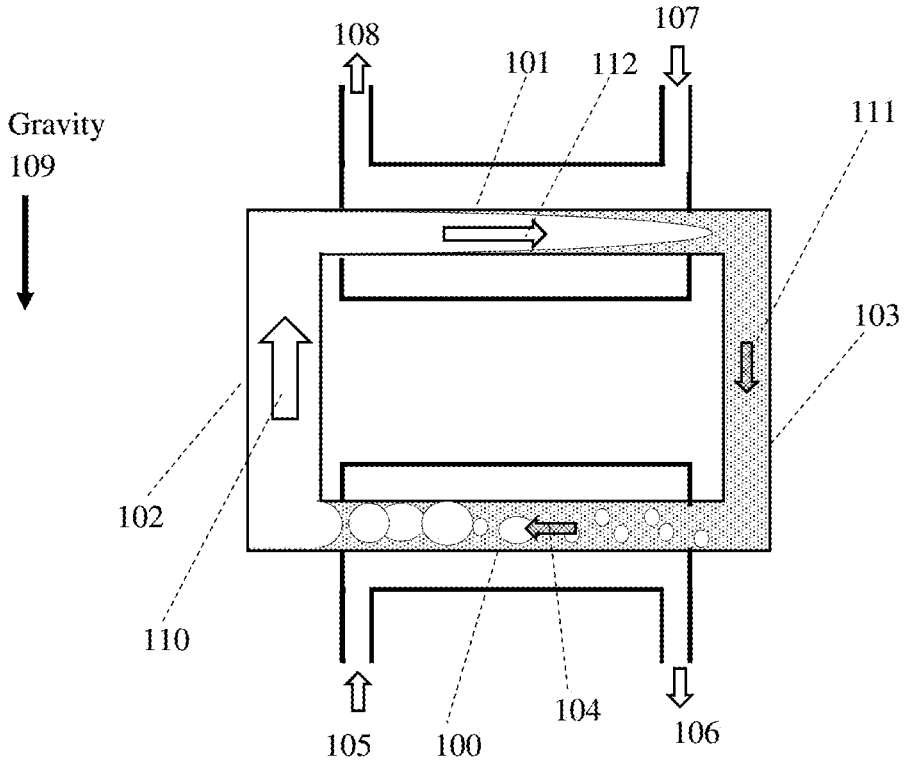
FIG. 2 is a schematic of one embodiment of a temperature glide thermosyphon.

A temperature glide thermosyphon (TGT) is a passive, two-phase heat transfer device in which gravity returns liquid from the condenser to the evaporator. The thermosyphon is charged with a non-azeotropic mixture of fluids. The basic principles of operation are presented in FIG. 2. The TGT consists of an evaporator 100, a condenser 101, a vapor supply line 102 connecting the evaporator to the condenser, and a liquid return line 103, connecting the condenser to the evaporator. The refrigerant flows in a continuous loop, and the circulation of refrigerant is driven by the pressure head created by gravity 109, from the liquid build up in the line 103 between the condenser 101 and the evaporator 100.

Figure 3:
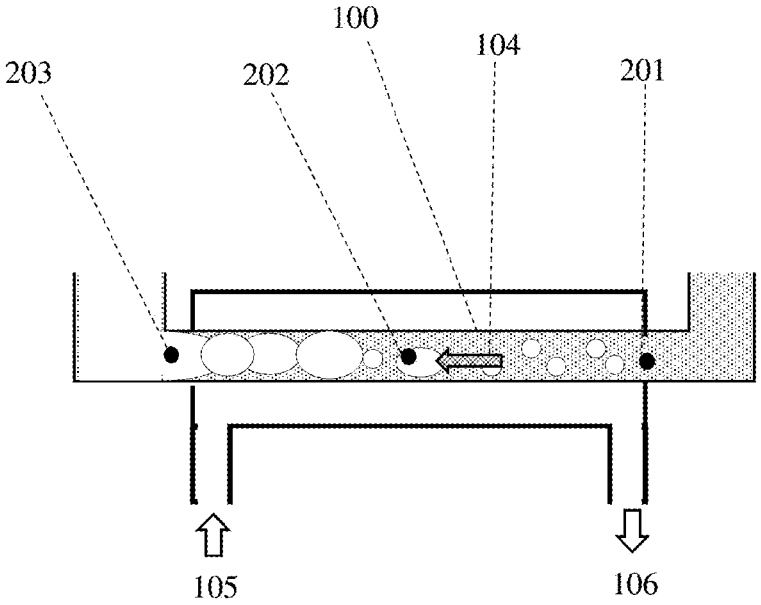
FIG. 3 is a schematic of one embodiment of the evaporator of a temperature glide thermosyphon.
Figure 4:
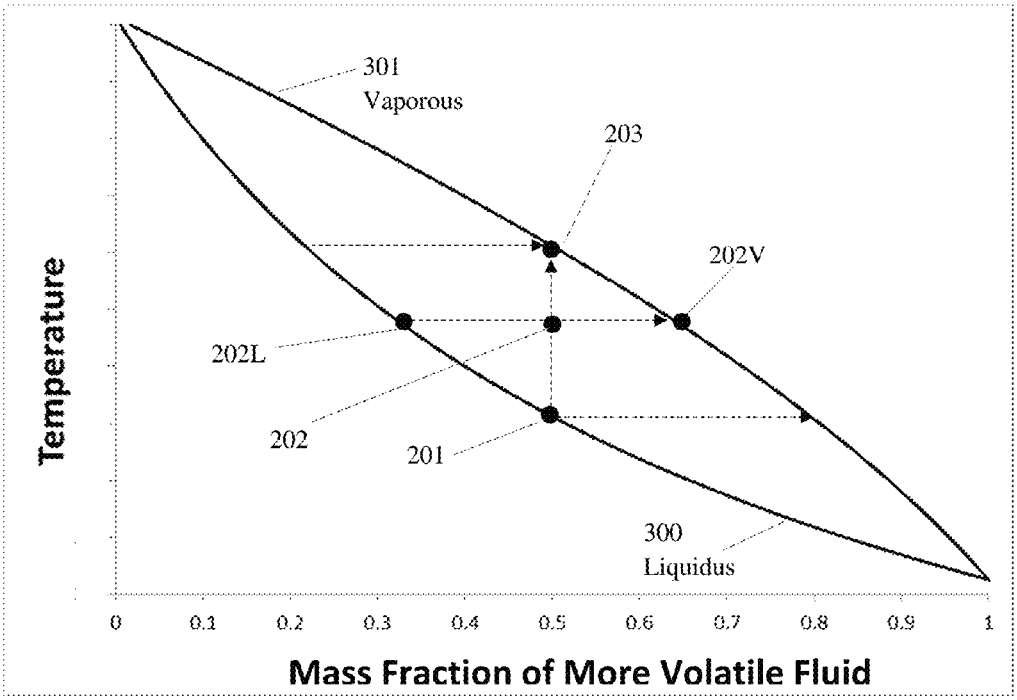
FIG. 4 is a phase diagram representing the evaporation process of one embodiment of the temperature glide thermosyphon.

In the evaporator 100, the refrigerant flows 104 counter to the hot fluid 105 entering it. A close up view of the evaporator 100 is presented in FIG. 3. The corresponding operating points on a representative phase diagram is presented in FIG. 4, for a zeotropic mixture at a constant temperature. The refrigerant enters 210 the evaporator 100 at a relatively low temperature. If the liquid is at the saturation temperature (versus sub-cooled), it'll be on the liquidus 300 line of the phase diagram. As the liquid starts to vaporize, the more volatile component is vaporized more quickly than the less volatile component. As the vapor quality increases, the temperature rises as the refrigerant progresses through the evaporator 100 to a point 202 in the middle of the evaporator 100. At this point, the less volatile component concentrates 202L in the liquid phase, when compared to the liquid entering 201 the evaporator 100. The corresponding mass fraction in the vapor phase 202V remains at equilibrium with the liquid phase, per the phase diagram, given that the temperature is the same on the liquid and vapor side of the liquid/vapor interface. The refrigerant leaving 203 the evaporator has a vapor quality of 1. The mass fraction of the more volatile component of the liquid entering the evaporator 201, and the vapor leaving the evaporator 203 are identical, thus obeying conservation of mass of a non-reacting system. The temperature glide effect is the temperature difference between the saturated vapor 203 leaving the evaporator and the saturated liquid 201 entering the evaporator.

Figure 5:
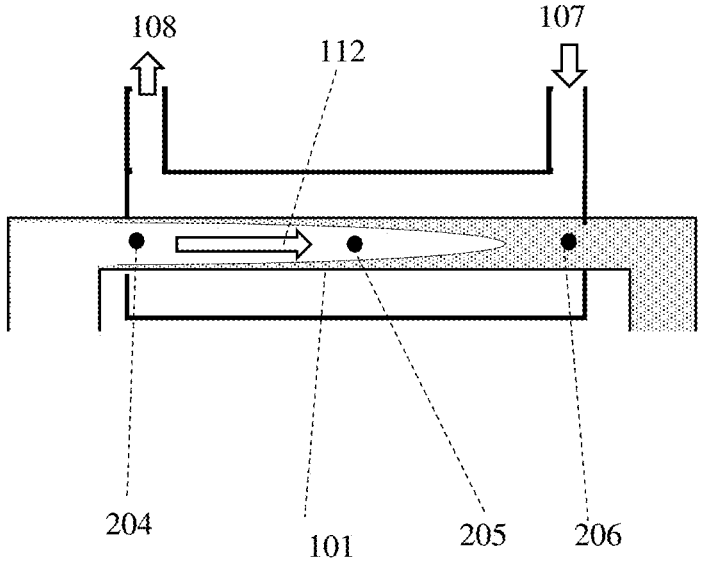
FIG. 5 is a schematic of one embodiment of the condenser of a temperature glide thermosyphon.
Figure 6:
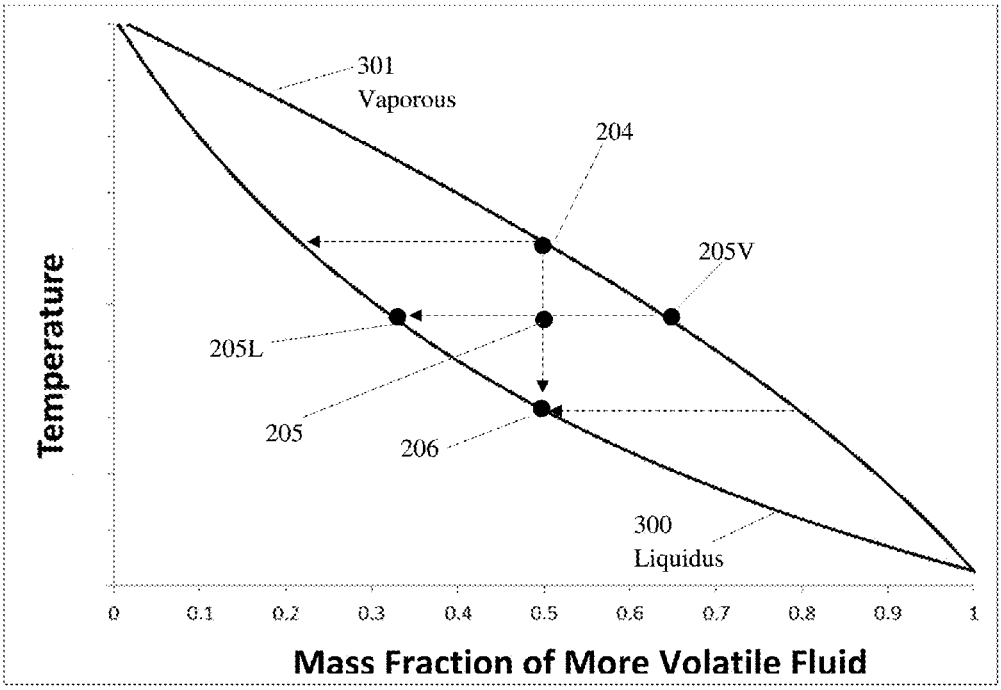
FIG. 6 is a phase diagram representing the condensation process of one embodiment of the temperature glide thermosyphon.

In the condenser 101, the coolant 107 and the refrigerant flow 112 counter to one-another. The detailed condensation process and corresponding points on the phase diagram are presented in FIG. 5 and FIG. 6, respectively. The refrigerant enters the condenser 204 as a saturated vapor, and in this example, falls on the vaporous 301 line on the phase diagram. During condensation, the less volatile component condenses more readily than the more volatile component. As the refrigerant progresses along the condenser 205, the more volatile component in the vapor concentrates 205V, while the local liquid mass fraction 205L maintains equilibrium with the vapor, since the temperature is the same on the liquid and vapor side of the liquid/vapor interface. The refrigerant can leave as a saturated liquid 206.

The net effect of the TGT system, is that a counter-flow heat exchanger effect may be induced by a single, self-circulating refrigerant loop, transferring heat between a hot and cold fluid stream. The maximum counter-flow effect that can be achieved is when the temperature glide effect approaches the temperature difference between the entering temperatures of the hot fluid 105 and the coolant fluid 107. If the temperature glide effect is greater than the temperature difference between the hot fluid in 105 and the coolant inlet 107, then the refrigerant circulation pattern won't start and no heat will be transferred between the two fluid streams.

The refrigerant can be any mixture of fluids that are miscible and are non-azeotropic. Some examples of potential mixtures are R134a and R245fa, R1234yf and R1234ze, water and methanol, water and ethanol, water and ammonia, and many more. To achieve the desired temperature glide effect, selection of working fluid combinations and fractions of each component is important. For instance, a mixture of R134a and R245fa can be selected in various proportions to get varying temperature glide effects, as presented in TABLE 1. A 50/50 mixture has a maximum effect of 14 C, while a 90/10 mixture only has a 5.5 C maximum effect.

TABLE 1

Various temperature glide effects of a binary mixture

| HFC 134a composition, by weight | HFC 245fa composition, by weight | Temperature Glide Effect |
|---|---|---|
| 50% | 50% | 14° C. |
| 75 | 25 | 10.5 |
| 90 | 10 | 5.5 |
| 100 | 0 | 0 |

When transferring heat between two sensible fluid streams, a nearly constant change in enthalpy per change in temperature, $$\left.\frac{dH}{dT}\right|_{P=const.},$$

of the evaporating and condensing refrigerant blend is a favorable characteristic, especially when the hot fluid and cold fluid release and gain sensible heat. It is important to note that the change of enthalpy versus temperature is not the specific heat, as it involves a phase change process, although the definition is the same. As the temperature glide effect increases, the change in enthalpy versus change in temperature tends to have peaks at both the high and low end of temperatures, with a valley in the middle, when a binary mixture is used. Mixtures of more than two components, are also possible, and can be engineered to give more constant change rate of change of enthalpy versus temperature. An example ternary mixture is propane plus iso-butane plus pentane. As the desired temperature glide effect increases, the number of mixture components can also increase.

The TGT is very beneficial for gas to gas or air to gas heat exchanger operations, since ducting can take up a lot of space to route air streams to the appropriate places. Also, in gas to air applications, the material selections may be driven by a single gas stream with contaminants, such as acids in combustion exhaust, where a separate gas stream (ambient air) may have less stringent material requirements. Limiting the expensive material to one heat exchanger, can represent major cost savings.

The evaporator and condenser for an air or gas heat exchanger may be a fin and tube type. The tube 113 routing of a fin 114 and tube type evaporator is presented in FIG. 7. In this embodiment, there are four (4) tube 113 passes. The refrigerant enters 111 the tube furthest away from the hot air 105 entering the heat exchanger. The refrigerant gets closer to the entering air on each subsequent pass, until it exits 110 the heat exchanger. This arrangement of airflow and tube routing can achieve the highest heat exchanger effectiveness. A similar configuration can be implemented for the condenser, only the entering air 105 is cool not hot, and the refrigerant entering 111 is vapor, not liquid.

Figure 7:
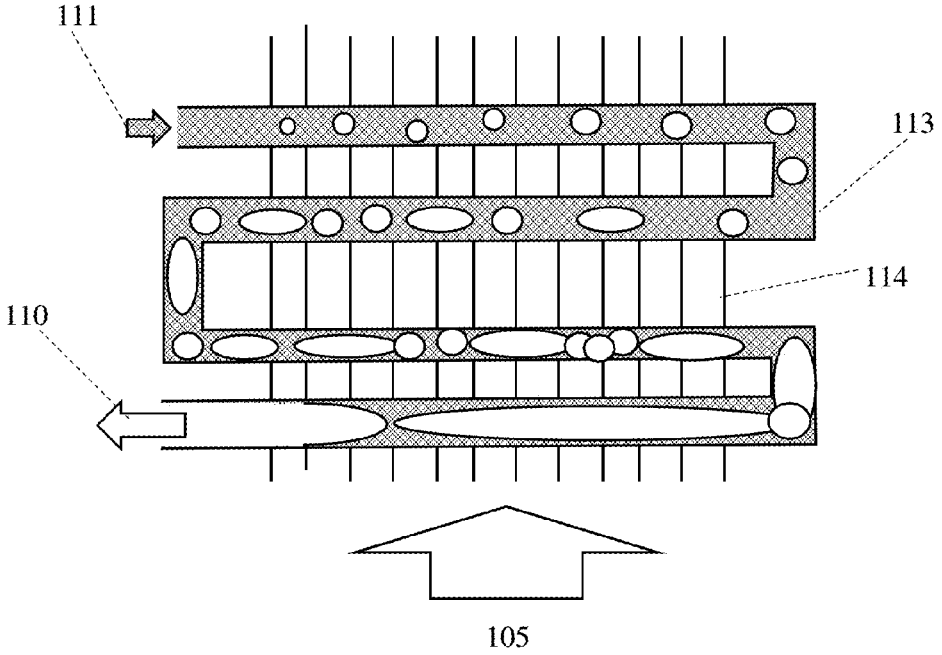
FIG. 7 is a schematic of a second embodiment of the evaporator of a temperature glide thermosyphon.
Figure 8:
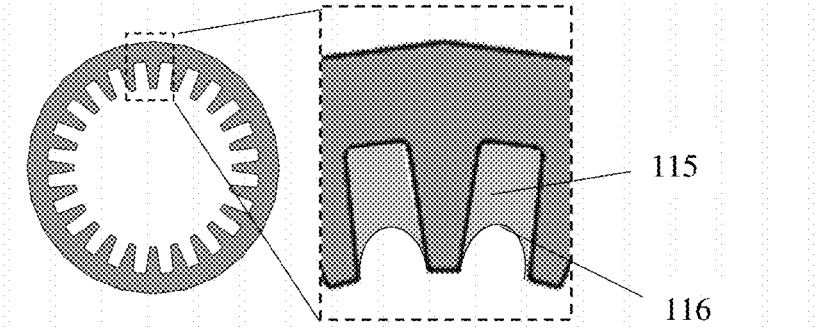
FIG. 8 is a cross-section of a tube in the second embodiment of the evaporator of a temperature glide thermosyphon.

Since refrigerant flow is driven by gravity, the overall impedance (pressure loss) to the refrigerant flow must be less than the gravitational potential available in the system integration. In some applications, this pressure loss is small relative to active systems (e.g. a vapor compression cycle), therefore, the relative vapor and liquid velocities inside the tubes must be low. Since these velocities are low, special consideration needs to be taken in the evaporator so that the liquid and vapor does not stratify (liquid pools on bottom of tube), since the liquid needs to wet the entire internal perimeter to achieve maximum performance. In this scenario, tubing with grooves is necessary, as shown in FIG. 7. For active systems, there is grooving available on the internal surface, however, the groove height is typically less than 50 μm, which does not prevent stratification. Therefore, typical tubing is not satisfactory for the TGT. For many refrigerants (e.g. hydrofluorocarbon, hydrofluoroolefin, or hydrocarbons), grooves with a height of 500-2000 μm, and a width of 500 to 2000 μm are necessary. The maximum width of the grooves is limited by the stability of the meniscus 116 to ensure that the liquid 115 stays inside the groove, even on the top side of the tube. If the groove is too wide, liquid will drip down, and no longer wet the entire periphery.

When a fin and tube heat exchanger is manufactured, the tubes are usually formed as hair pins, and are brazed with a u-bend segment to connect the open end of adjacent tubes. For the TGT, it may be necessary to use a grooved u-bend segment, versus a smooth inner bore, so that liquid continuously wets the top surface. At the transition between the straight segment and the u-bend, the spacing of the grooves needs to be close, so that liquid continuity is maintained. Close spacing may be achieved by chamfering the straight segment and the u-bend, so they fit like a bevel. Inserts, or other methods, may be used to ensure a continuous groove is maintained.

Figure 9:
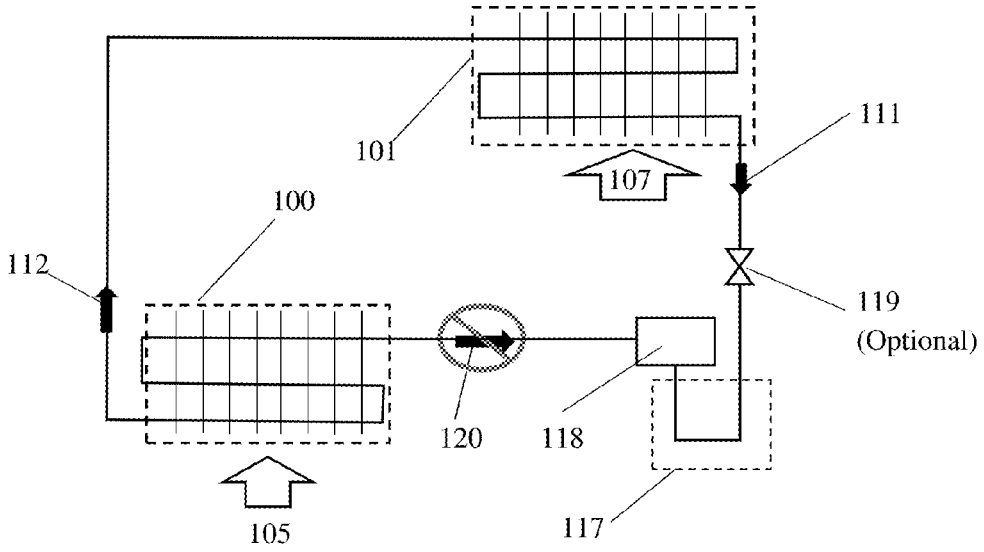
FIG. 9 is a schematic of another embodiment of the temperature glide thermosyphon.

In some circumstances, additional measures may need to be taken to ensure the refrigerant flows in the intended direction. FIG. 9 illustrates one method that can be used to ensure the refrigerant flow goes in the correct direction. The vapor 112 flows from the evaporator 100 to the condenser 101. Liquid 111 then leaves the condenser, and flows through a U-shaped trap 117. During start-up, vapor may just as easily flow backwards 120 from the evaporator 105 to the condenser 101. The liquid settling at the bottom of the U-trap, will prevent the vapor backflow 120 and help ensure the direction of the refrigerant flow moves as intended. Noting the tube routing in FIG. 9, the refrigerant flows counter to both the hot air stream 105 and the cool air stream 107, therefore ensuring the flow moves in a prescribed direction is imperative to overall system performance.

Additional design elements may be added to the TGT to increase the functionality or lessen constraints of the system. One of these features is a liquid collection chamber 118. The chamber 118 can hold a reservoir of liquid, and contain vapor at the top. If the volume of this chamber is large compared to the liquid line connecting the condenser 101 to the evaporator 100, then small changes in liquid height in the reservoir can lead to large changes in liquid pressure head that drive the system. Since the vapor flow 112 is passively activated by a heat source 105, the refrigerant flow is controlled only by the heat input. The reservoir 118 helps ensure that there is enough gravitational pressure head to support the heat load. The reservoir 118 can help alleviate some of the sensitivity of the initial refrigerant charge, since too much or too little refrigerant in the TGT can lead to degraded performance.

Another, optional feature that can be implemented in the TGT is a flow control valve 119. This valve can be controlled by a control system, or manually. Without the valve, the TGT will transfer heat from the hot air stream 105 to the cold air stream 107. The valve, can be open and allow this heat to be transferred, closed, to stop the circulation of refrigerant, and thus stop the heat transfer, or somewhere in between, to allow for a specific amount of heat to be transferred.

Figure 10:
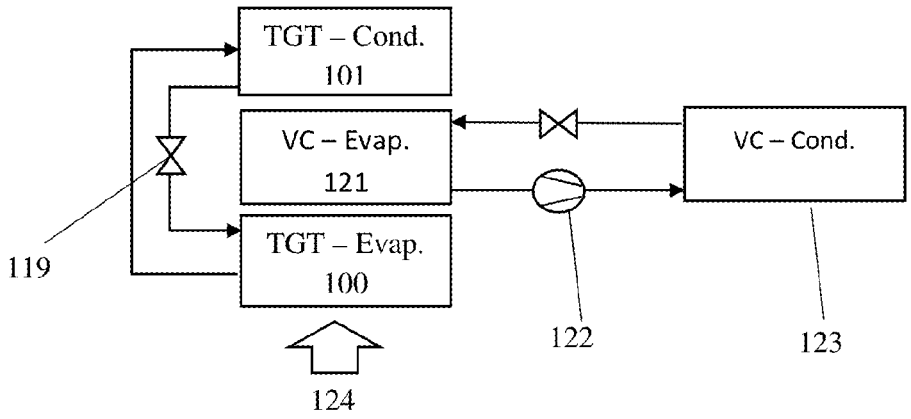
FIG. 10 is a schematic of the temperature glide thermosyphon implemented around the evaporator of a vapor compression cycle.

One application where flow control on the TGT is useful, is on a heat recovery unit, around an evaporator coil 121 of a vapor compression (VC) refrigeration cycle, as shown in FIG. 10. In this configuration, the TGT condenser 101 both reheats the coil air leaving the VC evaporator 121, and uses that heat to cool the air entering 124 the VC evaporator 121, through the TGT evaporator 100. The TGT in this configuration can lower the sensible heat ratio (SHR) of the vapor compression cycle, which allows it to remove more latent heat (humidity) from the air, relative to the total heat removed, than without the heat recovery unit. Since the TGT can be implemented in a single loop, the TGT control valve 119 can be used to regulate the amount of heat recovered. The ability to control the amount of heat recovered, enabling dynamic control of the SHR. In cases where dehumidification is more important than temperature control, heat recovery can significantly reduce the amount of power consumed by the compressor 122. It can also lead to a lower condenser temperature 123, since the heat load to it may be reduced, thereby increasing the vapor compression cycle's coefficient of performance.

Another consideration for the TGT is that gravity has been described as the primary force to enable the passive circulation of refrigerant flow. Any inertial force may be used to provide the needed pressure head to drive the self-circulation. One such force is a centrifugal force. In this case, the evaporator would be located at a radius that is greater than the condenser, with respect to the rotating axis.

Figure 11:
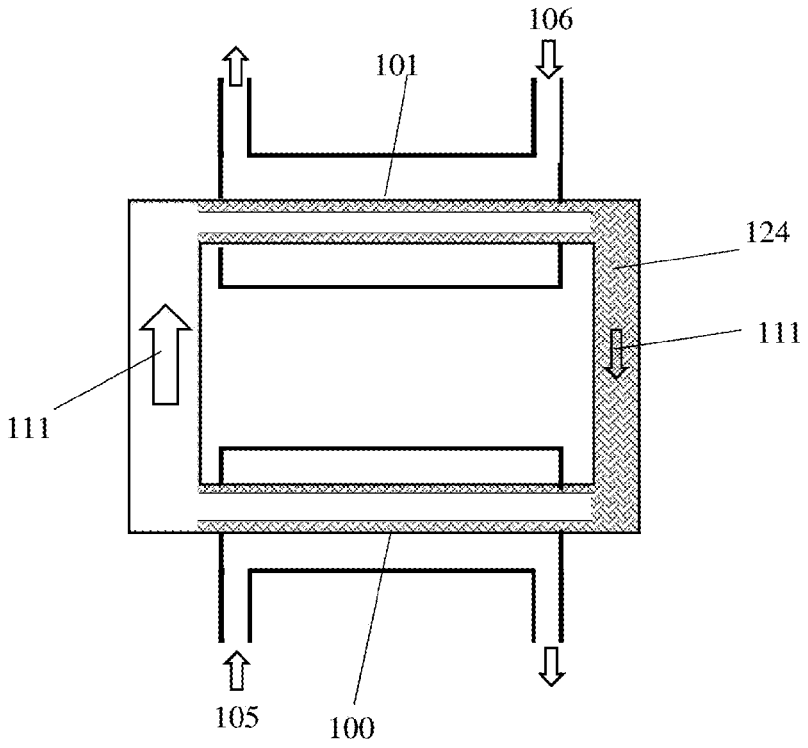
FIG. 11 is a schematic of one embodiment of a temperature glide heat pipe.

When an inertial force can't be guaranteed, capillarity may be used to pump liquid. When capillarity is used, the device can be called a temperature glide heat pipe (TGHP). A representation of the TGHP is shown in FIG. 11. There is a continuous wick 124, connecting the condenser 101 and the evaporator 100. Liquid 111 is pumped through the wick 124 by capillarity. Vapor 111 flows from the evaporator 100 to the condenser 101, through a line that does not contain a wick. The absence of a wick in the vapor line ensures the directionality of the flow. The wick, as shown in the embodiment in FIG. 11, covers the entire cross-section of the liquid tube between the condenser 101 and the evaporator 100. Inside the evaporator 100 and condenser 101 the wick does not cover the entire cross-section, and allows vapor to flow through a hollow core. Similar to the TGT, the hot fluid 105 releasing heat in the evaporator 100 flows counter to the refrigerant inside. The same is true in the condenser 101 where a cool fluid 106 flows counter to the refrigerant.

Suitable refrigerants for the TGHP will have a relative high latent heat and a relatively high surface tension. The refrigerant can be any non-azeotropic mixture of fluids. Some examples are ammonia and water, and methanol and water.

Figure 12:
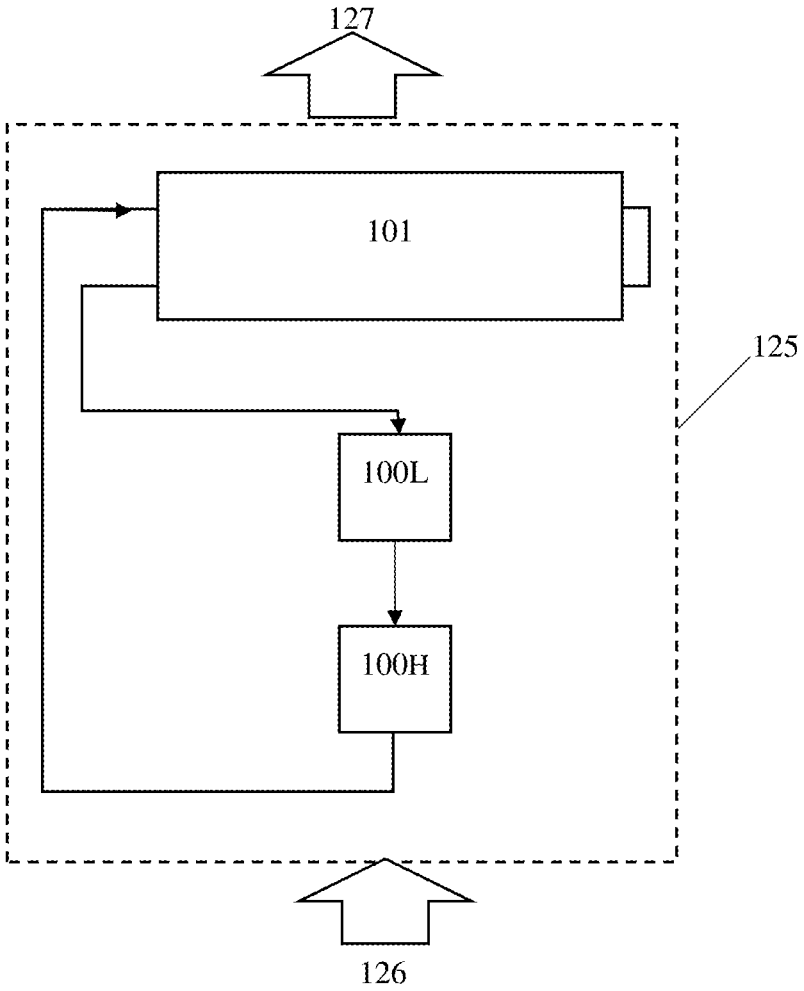
FIG. 12 is a schematic of a temperature glide thermosyphon or temperature glide heat pipe coupled to multiple heat generating components.

The TGT and TGHP can both be utilized to manage electronic components. A schematic of an electronics system 125 is presented in FIG. 12. The cooling air enters 126 the electronics system 125 from one side, and exhausts 127 from the opposite side. The TGT or TGHP has two evaporators 100L 100H, connecting to two heat generating electronics components. One component has relatively low temperature requirement, and is cooled by the first evaporator 100L connected to the liquid line of the condenser 101. One component has a higher temperature requirement and is connected to a second evaporator 100H, which is downstream, with respect to the refrigerant flow, of the first evaporator 100L. In this situation, if each component was cooled with a stand-alone heat sink, the component with a lower temperature requirement would receive hotter air than the component with the higher temperature requirement. The TGT and the TGHP allow more sensitive to temperature components to be cooled to a lower temperature.

What is claimed is:

1. A thermosyphon system; comprising an evaporator;

a condenser;

a liquid line fluidly coupling the condenser to the evaporator;

a vapor line fluidly coupling the evaporator to the condenser;

a refrigerant, wherein the refrigerant vaporizes as it progresses through the evaporator, passes through the vapor line from the evaporator to the condenser wherein vapor condenses to a liquid and passes through the liquid line from the condenser to the evaporator;

wherein the evaporator, condenser, liquid line and vapor line operate at substantially the same pressure;

wherein the refrigerant is a non-azeotropic mixture of two or more fluids; and wherein a condenser coolant flows counter to the refrigerant inside the condenser.

2. The thermosyphon system of claim 1, wherein a hot fluid external to the thermosyphon system releases heat to the evaporator as it flows counter to the refrigerant inside the evaporator.

3. The thermosyphon system of claim 1, wherein the liquid line includes a U-shaped liquid trap.

4. The thermosyphon system of claim 1, wherein the liquid line includes a U-shaped liquid trap and further includes a liquid collection chamber downstream of the liquid trap.

5. The thermosyphon system of claim 1, wherein the liquid line includes a flow control valve.

6. The thermosyphon system of claim 1, wherein the evaporator is a fin and tube design, and one or more of the evaporator tubes have grooves that are approximately 0.5 mm to 2.0 mm wide and approximately 0.5 mm to 2.0 mm high.

7. The thermosyphon system of claim 1, wherein the evaporator is a fin and tube design, and one or more of the evaporator tubes have grooves that are approximately 0.5 mm to 2.0 mm wide and approximately 0.5 mm to 2.0 mm high, and wherein one or more U-bend brazing connections consist of a grooved tubes.

8. The thermosyphon system of claim 1, wherein multiple evaporators are fluidly coupled in series.

* * * * *